US007588441B2

(12) United States Patent
Chang et al.

(10) Patent No.: US 7,588,441 B2
(45) Date of Patent: Sep. 15, 2009

(54) ELECTRICAL CONNECTOR WITH IMPROVED HOUSING STRUCTURE

(75) Inventors: Chun-Yi Chang, Tu-cheng (TW); Fang-Chu Liao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/221,586

(22) Filed: Aug. 4, 2008

(65) Prior Publication Data

US 2009/0035995 A1 Feb. 5, 2009

(30) Foreign Application Priority Data

Aug. 3, 2007 (CN) ..... 2007 2 0041177 U

(51) Int. Cl.
*H01R 12/00* (2006.01)

(52) U.S. Cl. ..... 439/66; 439/862

(58) Field of Classification Search ..... 439/66, 439/862, 733.1
See application file for complete search history.

(56) References Cited

U.S. PATENT DOCUMENTS

| | | | | |
|---|---|---|---|---|
| 5,479,320 | A * | 12/1995 | Estes et al. | 439/66 |
| 6,120,328 | A * | 9/2000 | Bricaud et al. | 439/862 |
| 6,764,315 | B2 * | 7/2004 | Ng et al. | 439/66 |
| 7,435,100 | B2 * | 10/2008 | Chang et al. | 439/66 |
| 2005/0130510 | A1 * | 6/2005 | Zheng et al. | 439/862 |

* cited by examiner

*Primary Examiner*—Tho D Ta
(74) *Attorney, Agent, or Firm*—Wei Te Chung

(57) ABSTRACT

An electrical connector includes an insulative housing having a number of contact receiving passageways and a number of contacts received in the contact receiving passageways of the housing. Each of the contacts includes a main body and a spring contact arm extending upwardly from the main body. The contacts disposed in the housing are divided into a first group in a first area and a second group in a second area of the housing. The spring contact arms of the first and second group extend in different directions and opposite to each other. The insulative housing defines a plurality of recesses between the first area and second area.

8 Claims, 4 Drawing Sheets

3

ELECTRICAL CONNECTOR WITH IMPROVED HOUSING STRUCTURE

BACKGROUND OF THE INVENTION

1. Field of the Invention

The present invention relates to an electrical connector, and more particularly to an electrical connector with an improved housing which could reduce warpage of the housing.

2. Description of the Prior Art

With the advent of the electronic age, electronic products have been more and more used in the production and life, and the request of the quality and other aspects thereof is continue to raise. Among many electronic products, computer should be said to be applied considerable and the replacement, also could be said to be advancing with the times, the electrical connector disposed in the computer used to electrically connect an IC chip and a printed circuit board are also replacement constantly. The electrical connector comprises an insulative housing formed with a plurality of contact receiving passageways and a plurality of contacts received in the contact receiving passageways. Recently, the insulative housing of the electrical connector are manufactured more thinner and the number of the contact receiving passageways aligned thereon is are more and more, so it is difficult to control the flatness of the insulative housing. In additional, some of the insulative housings have different structure to adapt the various structures of the contacts, thus will make the insulative housing warpage after the insulative housing is molded. Hence, a new design which can improve the warpage of the insulative housing is required.

SUMMARY OF THE INVENTION

According, one object of the present invention is to provide an electrical connector with an improved housing to reduce the warpage of the housing for well establishing an electrical connection between an IC chip and a printed circuit board.

In order to achieve the object set forth, an electrical connector comprises an insulative housing having a plurality of contact receiving passageways and a plurality of contacts received in the contact receiving passageways of the housing. Each of the contacts includes a main body and a spring contact arm extending upwardly from the main body. The contacts disposed in the housing are divided into a first group in a first area and a second group in a second area of the housing. The spring contact arms of the first and second group extend in different directions and opposite to each other. The insulative housing defines a plurality of recesses between the first area and second area.

DESCRIPTION OF PREFERRED EMBODIMENT OF THE INVENTION

Reference will now be made to the drawings to describe the present invention in detail.

Figure 1:
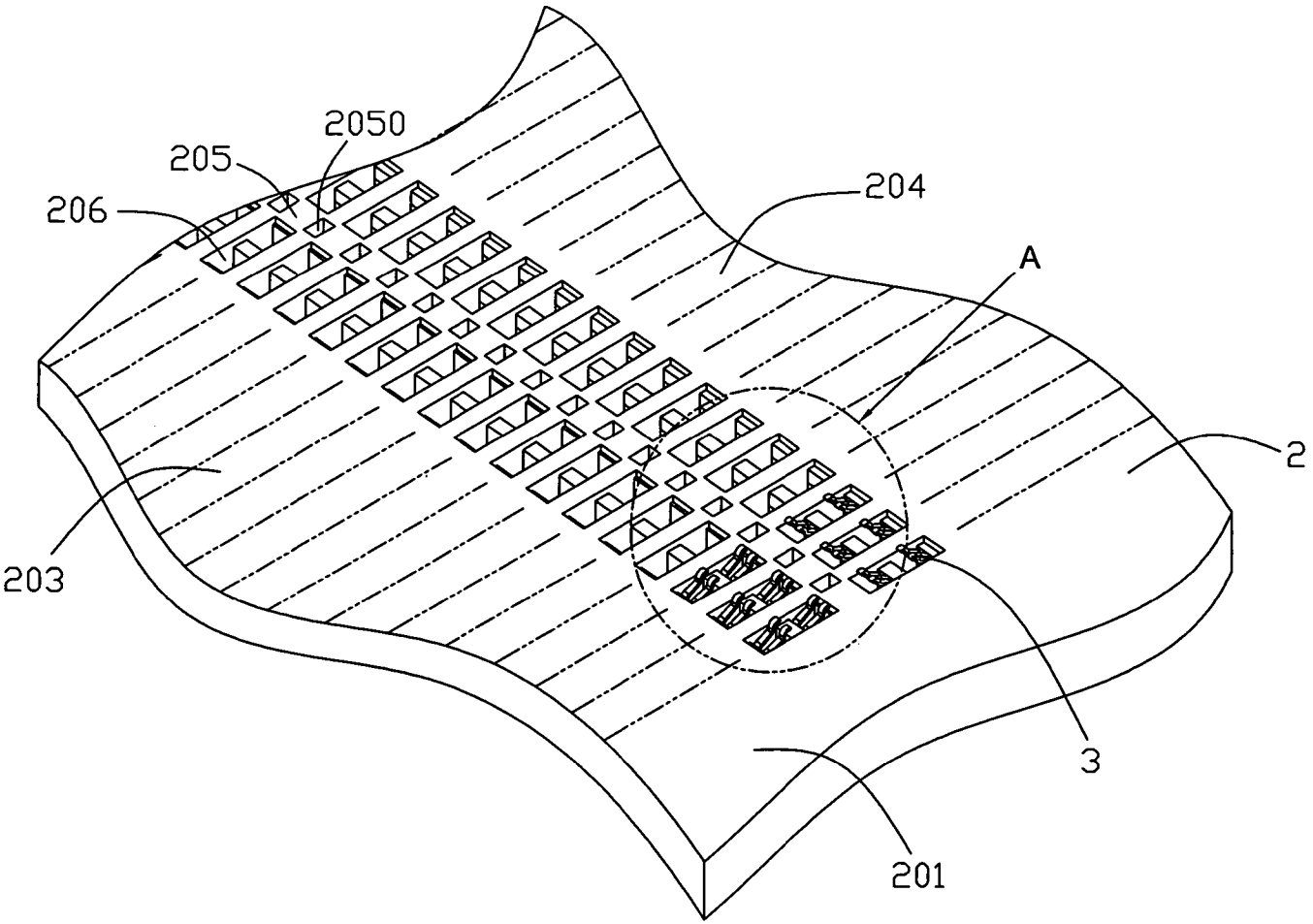
FIG. 1 is a schematic view of the insulative housing with contacts of the present invention.
Figure 2:
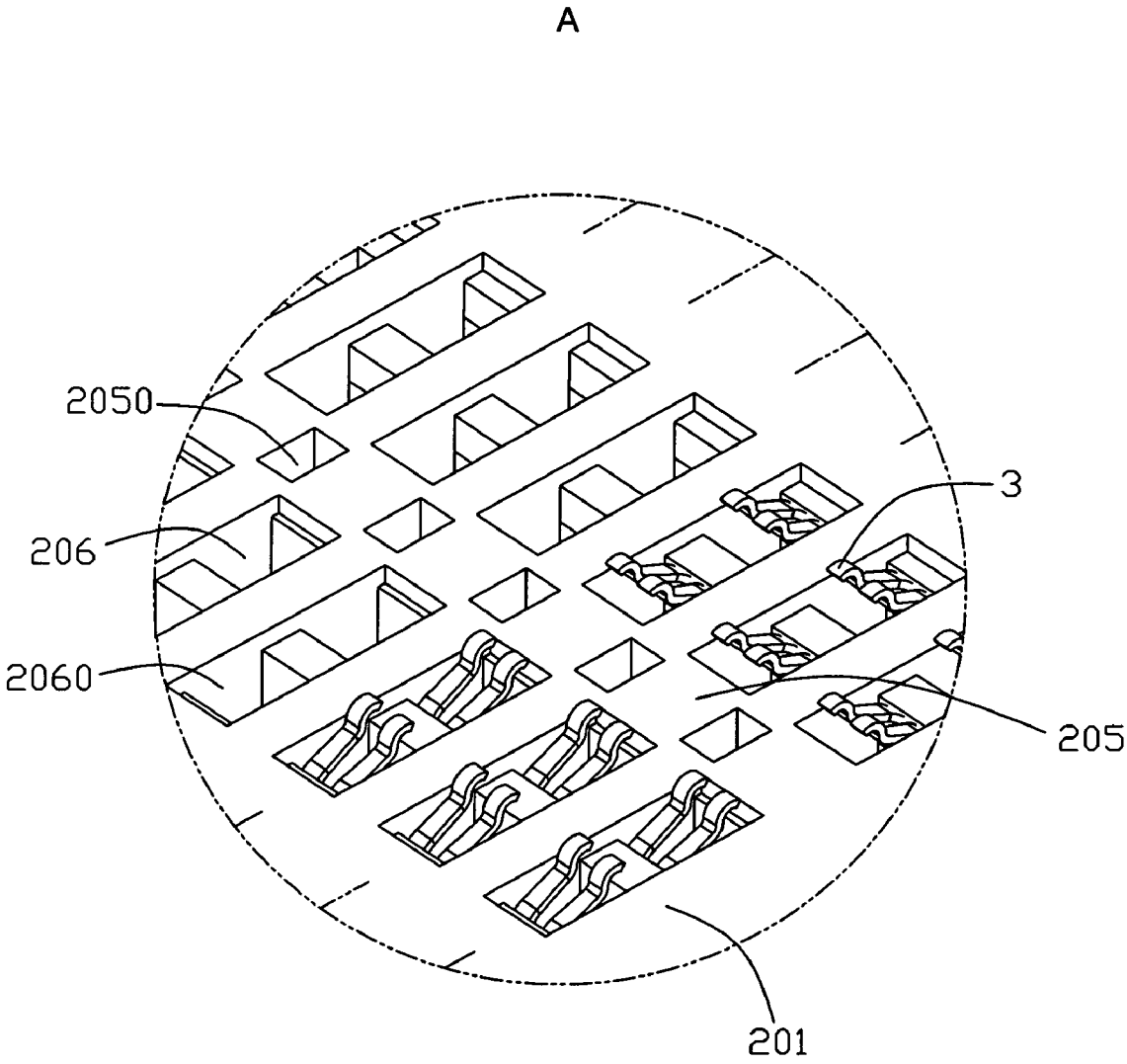
FIG. 2 is an enlarged view of circle A of FIG. 1.
Figure 3:
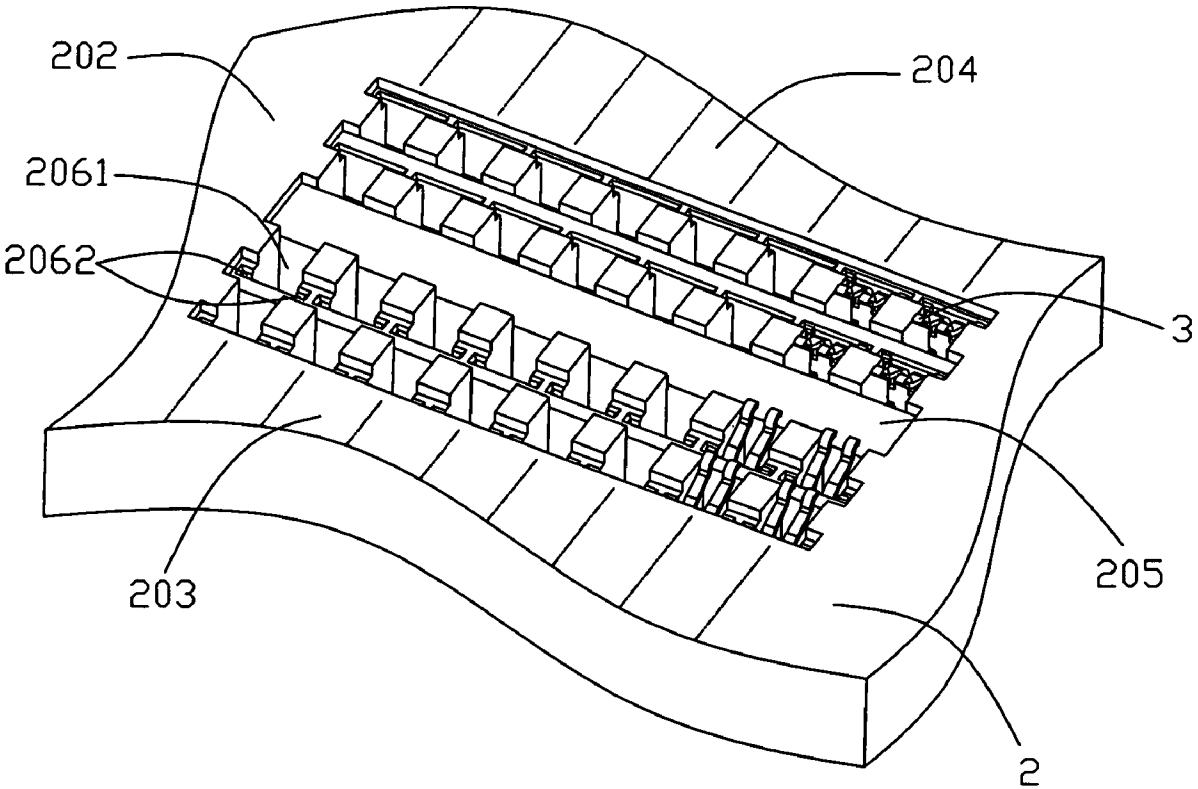
FIG. 3 is another schematic view of FIG. 1 from bottom end.

Referring to FIG. 1 to FIG. 3, an electrical connector is used to electrically connect an IC chip (not shown) and a printed circuit board (not shown). The electrical connector comprise an insulative housing 2, a plurality of contacts 3 received in the insulative housing 2, a metal stiffener (not shown) partially surrounding the insulative housing 2, a metal cover (not shown) and a lever (not shown) respectively pivotally mounted to and received in the opposite ends of the metal stiffener.

The insulative housing 2 is substantially rectangular and comprises a planar base (not labeled) and surrounding walls (not labeled) extending upwardly from four sides of the base. The base and the surrounding walls together define a receiving space to receive the IC chip. The base comprises a top surface served as a mating surface 201 for arranging the IC chip thereon and a bottom surface served as a mounting surface 202 attached to a printed circuit board. The base is divided into a first contact area 203, a second contact area 204 and a partitional section 205 arranged between the first and the second contact area 203, 204. The first and second contact area 203, 204 each defines a plurality of contact receiving passageways 206 penetrating the mating surface 201 and the mounting surface 202 for receiving the contacts 3. Each of the passageways 206 includes an upper space 2060 extending to the mating surface 201 and a lower space 2061 extending to the mounting surface 202 for receiving different part of the contact 3. The lower space 2061 has a pair of slits 2062 at outer side of the upper space 2060 thereby the width of the lower space 2061 is larger than the upper space 2060. The partitional section 205 defines a plurality of recesses 2050 open to the mating surface 201. The recesses 2050 are aligned in one line and sealed at the mounting surface 202 of the insulative housing 2. The recesses 2050 are perfectly defined in the same shape and size so as to manufacture easier. In the present embodiment, the recesses 2050 are all rectangular shape, however, it also could form a circle shape and other shape. The recesses 2050 are disposed around four contact receiving passageways 206 between the first contact area 203 and the second contact area 204 for having a bigger space to dispose therein. The mounting surface 202 of the insulative housing 2 has a number of standoffs (not shown) used to avoid the solder balls over melting when the electrical connector welds on the printed circuit board.

Figure 4:
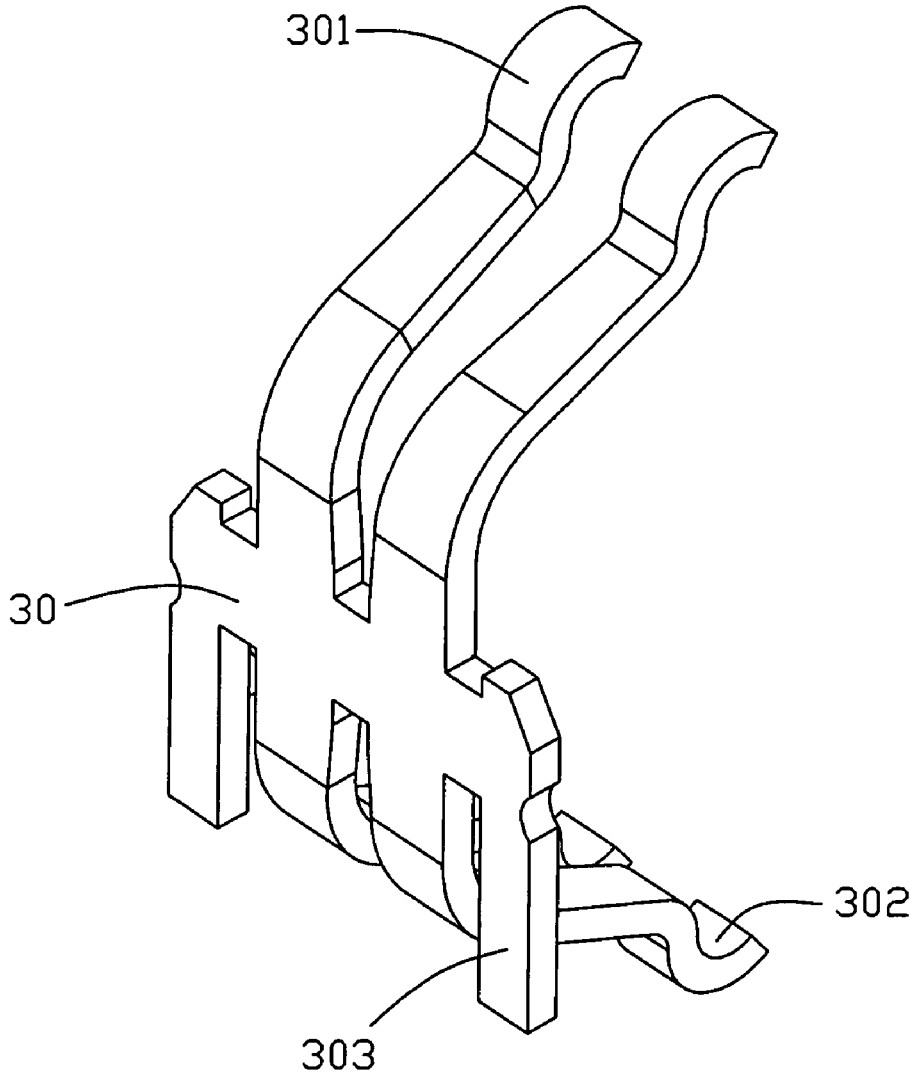
FIG. 4 is a perspective view of the contact of the present invention.

Referring to FIG. 4, the contact 3 comprises a main body 30 received in the contact receiving passageway 206, a pair of the spring contact arms 301 extending upwardly from top of the main body 30 toward the mating surface 201, a pair of spring solder arms 302 extending downwardly from bottom of the main body 30 toward the mounting surface 202, and a pair of tabs 303 formed on two sides of the main body 30 and extending downwardly at opposite sides of the spring solder arm 302. The spring contact arms 301 and the spring solder arms 302 are oriented in the same direction of the main body 30.

After assembling, the pair of spring contact arm 301 are received in the upper space 2060, the main body 30 and the pair of spring solder arms 302 are received in the lower space 2061, and the pair of tabs 303 are located in the slits 2062. The contacts 3 disposed in the first contact area 203 is called first group and disposed in the second contact area 204 is called second group. The spring contact arms 301 of the contacts 3 in the first group and second group are opposite to each other.

In the present embodiment, because the contact 3 has a pair of downwardly extending tabs 303 result in the upper space 2060 is relatively narrow than the lower space 2061. This structure will cause the insulative housing 2 generating warp in molding process. In order to reduce the warp, present invention dispose a plurality of recesses 2050 in the mating surface 201 of the partitional section 205, that can balance flow speed of melting plastic in the process of molding the insulative housing 2.

In assembly the electrical connector, the contacts 3 with solder balls (not shown) in the tail thereon are disposed in the contact receiving passageways 206. The metal cover and the lever are assembled to two ends of the metal stiffener. Then the electrical connector is positioned to the printed circuit board via the solder balls. Now, the electrical connector is assembled, then putting the IC chip on the insulative housing and close the metal cover and lever, thus stable electrical connection between the IC chip and the printed circuit board is assured.

In present embodiment, the insulative housing is divided into two contact areas, it also can be divided into more than this.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a plurality of contact receiving passageways, each of said contact receiving passageways defining a pair of passages; and a plurality of contacts received in the pair of passages of the corresponding contact receiving passageways of the housing, each of the contacts including a main body and a pair of spring contact arms extending upwardly from the main body, the contacts disposed in the housing being divided into a first group disposed in a first area of the insulative housing and a second group disposed in a second area of the insulative housing, the spring contact arms of the first and the second group extending in different directions and opposite to each other;

wherein the insulative housing defines a plurality of recesses between the first area and second area;

wherein each passageways includes an upper space for receiving the spring contact arm and a lower space for receiving the main body, and wherein the upper space and lower space have different shape;

wherein the insulative housing has a top surface and a bottom surface opposite to each other, and wherein the upper space is extending to the top surface and the lower space is extending to the bottom surface;

wherein the recesses are opened to the top surface and sealed at the bottom surface of the insulative housing.

2. The electrical connector as claimed in claim 1, wherein the width of the lower space is larger than the upper space.

3. The electrical connector as claimed in claim 1, wherein the insulative housing comprises a partitional section between the first area and second area of the insulative housing, and wherein the recesses are arranged on the partitional section.

4. The electrical connector as claimed in claim 1, wherein the lower space further comprising a pair of slits at outer sides of the upper space.

5. The electrical connector as claimed in claim 4, wherein each of the contacts further comprises a spring solder arm extending downwardly from the main body and a pair of tabs located at opposite sides of the spring solder arm.

6. The electrical connector as claimed in claim 5, wherein the pair of tabs are located in the slits and the spring solder arm is received in the lower space.

7. An electrical connector comprising:

an insulative housing defining opposite upper and lower surfaces;

a plurality of passageways formed in the housing and arranged in rows and columns, each of said passageways defining a pair of passages each extending through the housing in a vertical direction;

plural pairs of contacts disposed in the pair of passages of the corresponding passageways, respectively, each of said contacts including a pair of contacting sections extending beyond said opposite upper and lower surfaces, respectively;

the contacts disposed in the insulative housing being divided into a first group disposed in a first area of the insulative housing and a second group disposed in a second area of the insulative housing;

a plurality of recesses formed in at least one of said upper and lower surfaces among said passageways under a condition that each of said recess is offset from the neighboring passageways in either row direction or column direction;

wherein said recess does not extend through the opposite surface;

wherein the insulative housing comprises a partitional section between the first area and second area of the insulative housing and wherein the recesses are arranged on the partitional section;

wherein the pair of passages of the corresponding passageway are arranged in the column direction.

8. An electrical connector comprising:

an insulative housing defining opposite upper and lower surfaces;

a plurality of passageways formed in the housing and arranged in rows and columns, each of said passageways defining a pair of passages each extending through the housing in a vertical direction;

plural pairs of contacts disposed in the pair of passages of the corresponding passageways, respectively, each of said contacts including a pair of contacting sections extending beyond said opposite upper and lower surfaces, respectively;

the contacts disposed in the insulative housing being divided into a first group disposed in a first area of the insulative housing and a second group disposed in a second area of the insulative housing;

plural rows of recesses formed in at least one of said upper and lower surfaces among said passageways under a condition that each row of said recesses extends in a row direction through the corresponding passageway under a condition that the pair of passages of the corresponding passageway are arranged in a column direction perpendicular to said row direction;

wherein said recess does not extend through the opposite surface;

wherein the insulative housing comprises a partitional section between the first area and second area of the insulative housing, and wherein the recesses are arranged on the partitional section.

* * * * *